US007677489B2

(12) United States Patent
Phillips

(10) Patent No.: US 7,677,489 B2
(45) Date of Patent: Mar. 16, 2010

(54) WIRE CADDY

(76) Inventor: David E. Phillips, 2550 Irish Rd., Ida, MI (US) 48140

( * ) Notice: Subject to any disclaimer, the term of this patent is extended or adjusted under 35 U.S.C. 154(b) by 0 days.

(21) Appl. No.: 12/217,392

(22) Filed: Jul. 3, 2008

(65) Prior Publication Data

US 2009/0008492 A1 Jan. 8, 2009

Related U.S. Application Data

(60) Provisional application No. 60/958,576, filed on Jul. 6, 2007.

(51) Int. Cl.
*B65H 75/40* (2006.01)

(52) U.S. Cl. ..... 242/403.1; 242/404

(58) Field of Classification Search ..... 242/403, 242/403.1, 404, 557, 533.8
See application file for complete search history.

(56) References Cited

U.S. PATENT DOCUMENTS 5,285,981 A * 2/1994 Pavelka ..... 242/557
6,116,533 A * 9/2000 Elder ..... 242/594.4
6,270,094 B1 * 8/2001 Campbell ..... 280/47.19
6,422,504 B1 * 7/2002 Elder ..... 242/594.6
6,523,776 B1 * 2/2003 Elder ..... 242/594.4
7,004,422 B1 * 2/2006 Chen ..... 242/588
7,243,876 B2 * 7/2007 Robison ..... 242/557

* cited by examiner

*Primary Examiner*—Sang Kim
(74) *Attorney, Agent, or Firm*—Emch, Schaffer, Schaub & Porcello, Co., LPA

(57) ABSTRACT

The wire caddy is designed to hold single or multiple spools of electrical wire commonly used in the building trades. This device allows wire spools to be inserted onto a support shaft and retained onto the support shaft by insertion of a retaining pin through retaining pin holes in the end of the support shaft. Wire is guided off the spool through a guide hole in the support bracket.

The diameter of the support shaft is smaller than the diameter of the wire spool end plate center holes. The center line of the support shaft is positioned higher than the center line of the wire spool end plate holes. This creates a gap between the bottom of the support shaft and the edge of the wire spool hole. Thereby the wire spool is resting on and supported by the friction plate, and not the support shaft. Upon applying an upward pulling force, the wire spool is lifted off the friction plate allowing for uncoiling of the wire. Once the pulling force is stopped, the weight of the wire spool will force the wire spool end plates down onto a friction plate that will stop the turning momentum of the wire spool, causing the wire spool to stop quickly. By stopping the turning momentum quickly, turns of wire on the spool will not uncoil themselves thus preventing entanglement with each other.

4 Claims, 3 Drawing Sheets

WIRE CADDY

CROSS REFERENCE TO RELATED APPLICATIONS

This application claims the benefit of U.S. Provisional patent application Ser. No. 60/958,576 filed on Jul. 6, 2007.

BACKGROUND OF THE INVENTION

The present invention is generally directed to a wire caddy that can be used to hold spools of electrical wire that are commonly used in the building trades. Electrical wire is a necessary component of almost all building projects and the wire is wound around a cylindrical spool to store the wire. In use the wire is taken on the cylindrical spool to a job site in advance from the cylindrical spool as needed. Unfortunately, the cylindrical spools are not particularly stable and as the wire is advanced from the spool the spools have a tendency to fall over if they are placed on their flat end or to roll if they are positioned with longitudinal axis of the spool parallel to the floor. In either situation it is difficult to maintain the spools in the proper location and to keep the electrical wire from becoming tangled or caught in a manner that makes it more difficult to remove wire from the spool. It is also frequently necessary to use several types of wire at a job site which requires moving multiple spools to the desired location on the job site. As the spools are an awkward shape and somewhat heavy it is difficult to move more than one or two spools at a time without encountering problems.

The present invention solves these problems by providing a storage, transporting and dispensing device that allows a single or multiple spools of wire to be effectively handled at a job site.

SUMMARY OF THE INVENTION

The wire caddy of the present invention is designed to hold single or multiple spools of electrical wire commonly used in the building trades. This device allows wire spools to be inserted onto a support shaft and retained onto the support shaft by insertion of a retaining pin through retaining pin holes in the end of the support shaft. Wire is guided off the spool through a guide hole in the support bracket.

The uniqueness of this invention is that diameter of the support shaft is smaller than the diameter of the wire spool end plate center holes. The center line of the support shaft is positioned higher than the center line of the wire spool end plate holes. This creates a gap between the bottom of the support shaft and the edge of the wire spool hole. Thereby the wire spool is resting on and supported by the friction plate, and not the support shaft. Upon applying an upward pulling force, the wire spool is lifted off the friction plate allowing for uncoiling of the wire.

Once the pulling force is stopped, the weight of the wire spool will force the wire spool end plates down onto a friction plate that will stop the turning momentum of the wire spool, causing the wire spool to stop quickly. By stopping the turning momentum quickly, turns of wire on the spool will not uncoil themselves thus preventing entanglement with each other.

To further stop the entanglement and prevent wire from leaving the confines of the spool and becoming wrapped around the support shaft, the wire spool end plates set onto the friction plate surface thus containing the wire within the confines of the two wire spool end plates.

Other objects and advantages of the present invention will become apparent to those skilled in the art upon a review of the following detailed description of the preferred embodiments and the accompanying drawings.

The present cart invention is designed to attach four wire caddies to a frame with wheels attached, including a removable handle with tube holders to accept multiple accessory trays. The handle enables the movement of the cart to different locations. This unit is called a Master cart.

An Extension cart is assembled in the same manner as the Master cart, except the Extension cart does not have the wheel assembly. The Extension cart is coupled to the Master cart by removing the handle from the Master Cart receiver and inserting the coupler of the Extension cart into the Master Cart receiver and securing with a detent pin and/or optional thumb screw. The handle is then placed into the Extension Cart receiver and secured with a detent pin and/or optional thumb screw. The handle enables the movement of the coupled carts to different locations. Multiple Extension Carts can be coupled together.

DETAILED DESCRIPTION OF THE PREFERRED EMBODIMENT(S)

Figure 1:
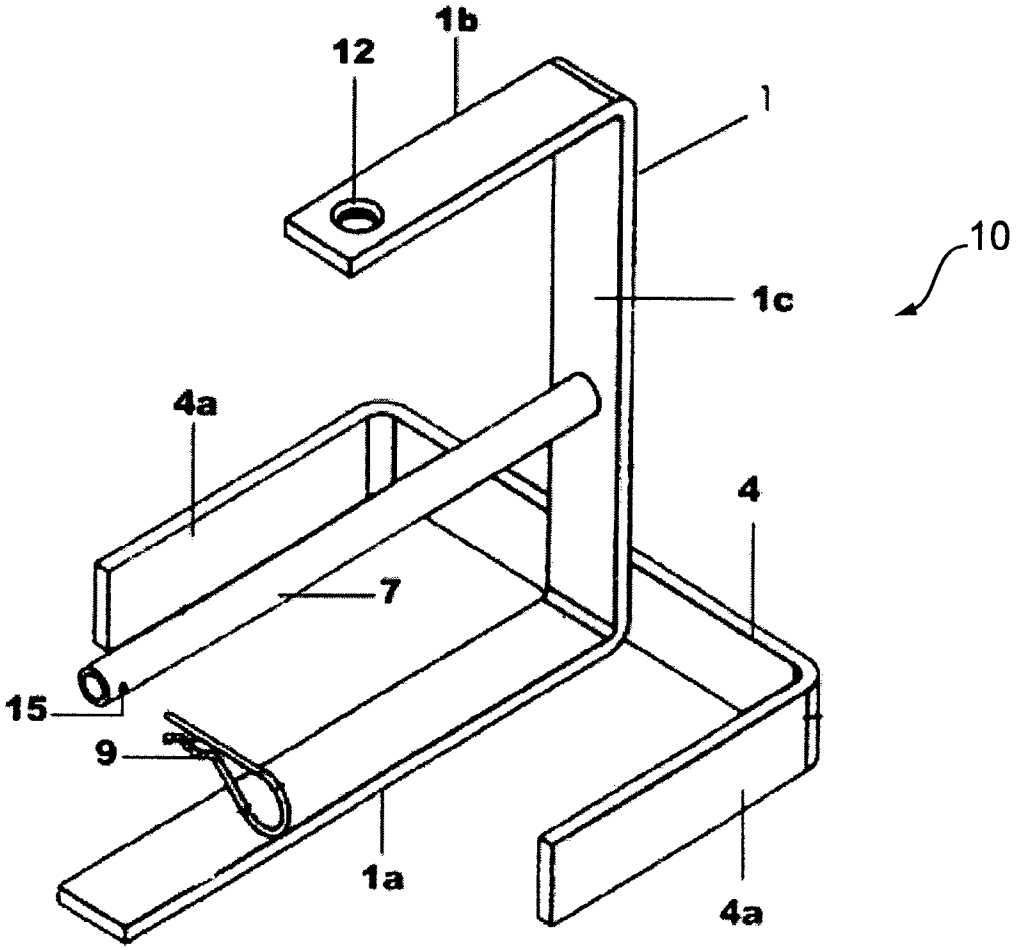
FIG. 1 is a perspective view of the invention.

The wire caddy of the present invention is designed to hold single or multiple spools of electrical wire commonly used in the building trades. This device allows wire spools to be inserted onto a support shaft and retained onto the support shaft by insertion of a retaining pin through retaining pin holes in the end of the support shaft. Wire is guided off the spool through a guide hole in the support bracket.

The uniqueness of this invention is that diameter of the support shaft is smaller than the diameter of the wire spool end plate 2 center holes 3. The center line of the support shaft is positioned higher than the center line of the wire spool end plate holes. This creates a gap between the bottom of the support shaft and the edge of the wire spool hole. Thereby the wire spool is resting on and supported by the friction plate, and not the support shaft. Upon applying an upward pulling force, the wire spool is lifted off the friction plate allowing for uncoiling of the wire.

Once the pulling force is stopped, the weight of the wire spool will force the wire spool end plates down onto a friction plate that will stop the turning momentum of the wire spool, causing the wire spool to stop quickly. By stopping the turning momentum quickly, turns of wire on the spool will not uncoil themselves thus preventing entanglement with each other.

To further stop the entanglement and prevent wire from leaving the confines of the spool and becoming wrapped around the support shaft, the wire spool end plates set onto the friction plate surface thus containing the wire within the confines of the two wire spool end plates.

The present cart invention is designed to attach four wire caddies to a frame with wheels attached, including a removable handle with tube holders to accept multiple accessory trays. The handle enables the movement of the cart to different locations. This unit is called a Master cart.

An Extension cart is assembled in the same manner as the Master cart, except the Extension cart does not have the wheel assembly. The Extension cart is coupled to the Master cart by removing the handle from the Master Cart receiver and inserting the coupler of the Extension cart into the Master Cart receiver and securing with a detent pin and/or optional thumb screw. The handle is then placed into the Extension Cart receiver and secured with a detent pin and/or optional thumb screw. The handle enables the movement of the coupled carts to different locations. Multiple Extension Carts can be coupled together.

The Master Cart has tray tube holders that receive support tubes. A rectangular middle tray with raised sides to contain loose parts or tools is placed over the support tubes and lowered onto stop pins, which are placed approximately midway on the support tubes. A top tray or print tray is placed on top of the support tubes. The top tray is a flat rectangle with raised sides to contain loose parts or tools. The top tray receivers are attached perpendicular to the tray surface, thus providing a level surface. The print tray is a large flat rectangle with a raised lip at the bottom edge used to keep blueprints, books, manuals, ect. from sliding off the inclined surface. The print tray receivers are set at an angle to the tray surface to create an inclined surface. The two sides and top of the tray are formed ninety degrees downward from the print tray surface, thus providing rigidity to the entire print tray.

The upper and lower wire caddy assemblies are placed at staggered heights on the main frame. This allows the carts to be shorter in length, save material and still be able to use the same diameter wire spools on all of the wire caddies.

As shown in FIGS. 1, 3, 4, 5 and 6 the support wire caddy 10 has a bracket 1 is formed of three sections 1*a*, 1*b* and 1*c*. The bottom horizontal section 1*a* is longer than the vertical section 1*c* and the top horizontal section 1*b*. The top section 1*b* contains a wire guide hole 12. A support shaft 7 extends from the vertical section 1*c*. The support shaft 7 is substantially parallel to the bottom 1*a* and top 1*b* sections of the support bracket 1*a*. The support shaft 7 extends from the vertical section in the same direction that the bottom 1*a* and top 1*b* sections extend from the vertical section 1*c*. The support shaft 7 is disposed to hold a spool 6 of wire 8. The bottom horizontal section 1*a*, of support bracket 1, is designed to perform multiple functions. The length of bottom vertical section 1*a* is substantially equal in length to support shaft 7, to support the weight of wire spools and prevent tipping. The upper surface of bottom vertical section 1*a*, functions as friction plate surface 19.

Vertical section 1*c* is attached perpendicular to the bottom horizontal section 1*a*. The top horizontal section 1*b* is attached at a ninety degree angle to vertical section 1*c* oriented in the same direction as bottom horizontal section 1*a*. A stabilizing bracket 4 is attached to the back side of support bracket 1, with the legs 4*a* parallel to bottom horizontal section 1*a* and oriented in the same direction as bottom horizontal section 1*a*. The support bracket 1 is centered between legs 4*a*. The bottom surface of stabilizing bracket 4 and the bottom surface of bottom horizontal section 1*a* are on substantially the same plane.

Support shaft 7 is attached to the inner surface of vertical support bracket 1*c* and centered between the vertical edges of vertical support bracket 1*c*. Support shaft 7 is parallel to bottom horizontal section 1*a*. The attachment height of support shaft 7 is dependant on the diameter of the wire spool 6.

Two retaining pin holes 15 are drilled near the end of support shaft 7. The drilled holes are at the end of support shaft 7 that is opposite the end of support shaft 7 which is attached to vertical section 1*c*. The retaining pin holes 15 accept retaining pin 9 that is used to secure a spool 6 of wire on the support shaft.

Attachment of all parts is done by welding or other appropriate means.

Construction

Figure 2:
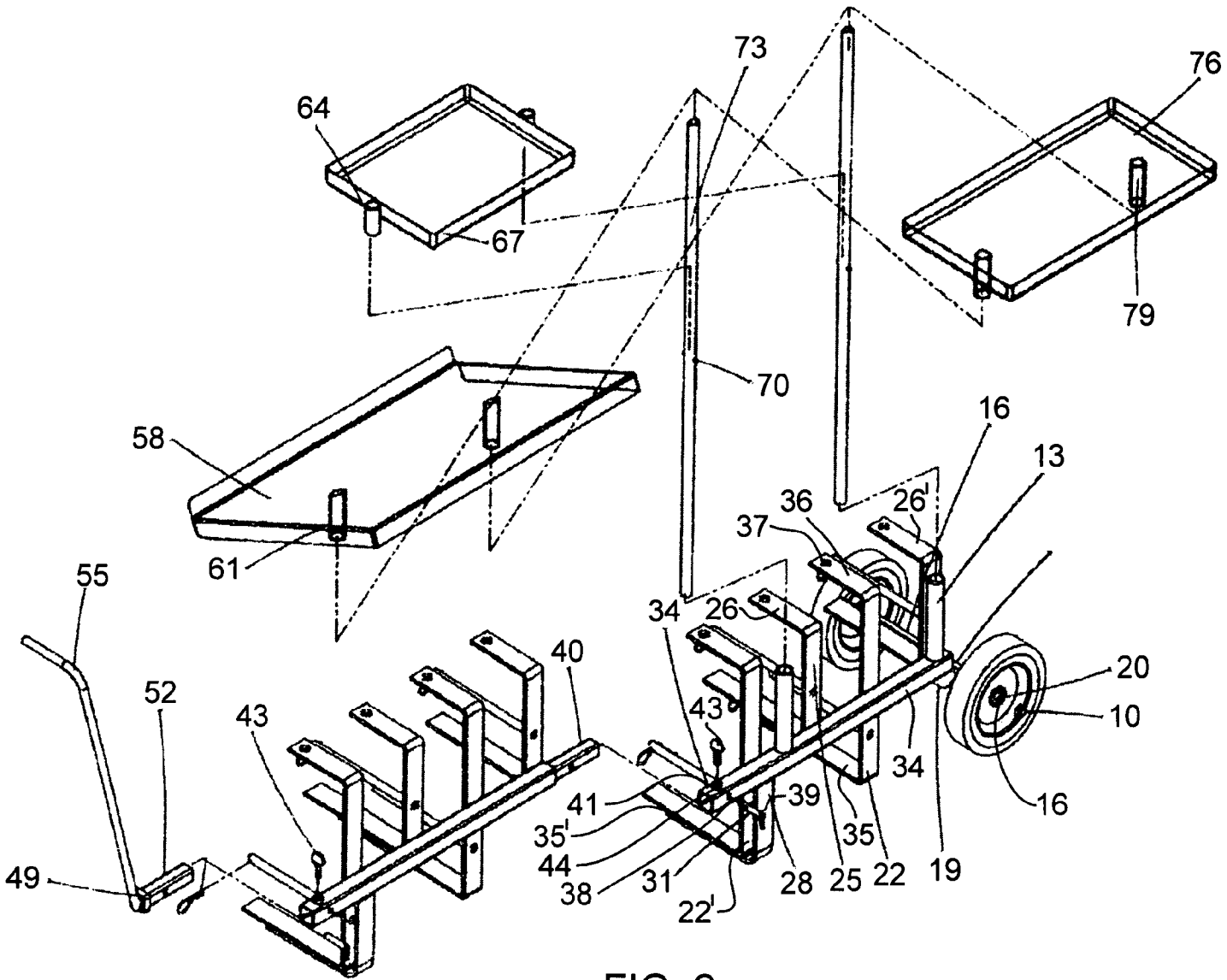
FIG. 2 is an exploded perspective view of additional features of the invention.
Figure 5:
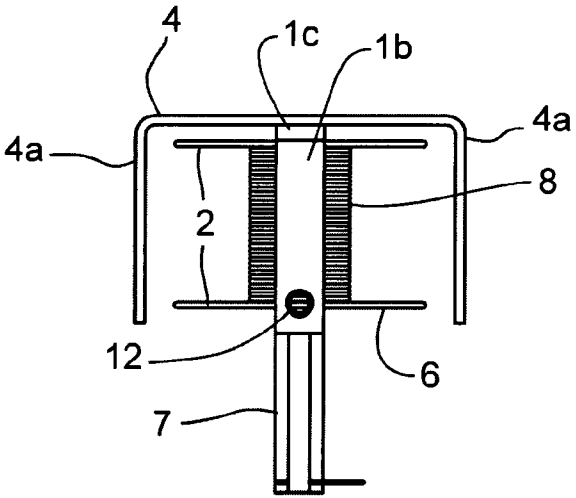
FIG. 5 is a top view of the caddy.
Figure 6:
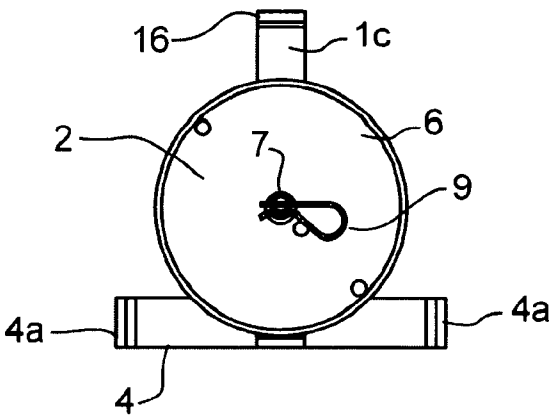
FIG. 6 is a right side elevational view of the invention.
Figure 3:
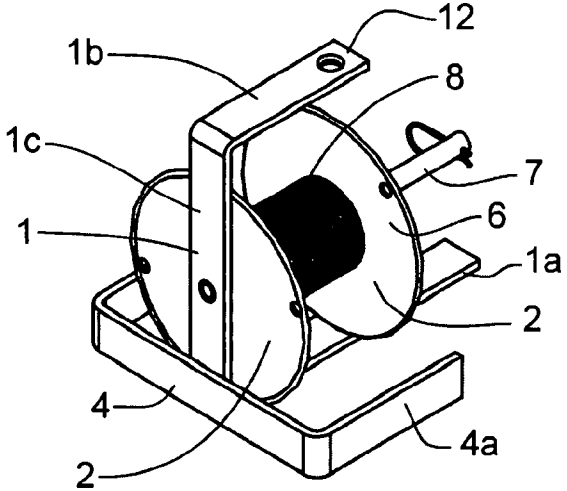
FIG. 3 is a perspective view of the caddy.
Figure 4:
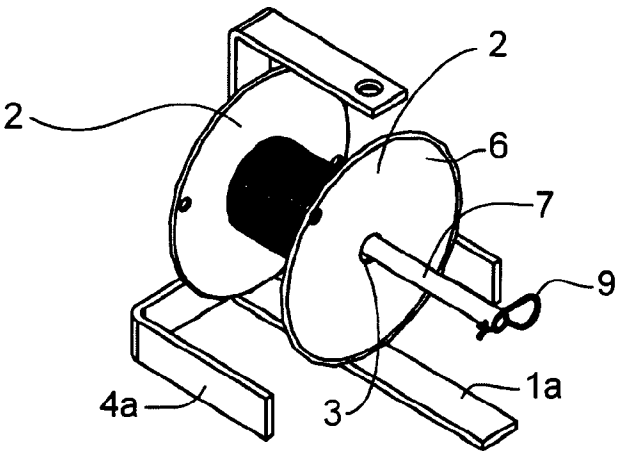
FIG. 4 is a perspective view of the caddy.

As shown in FIG. 2, the cart has a main frame 34 and a back plate 19. One end of the main frame 34 is attached perpendicular to one end of back plate 19. Axle rod 16 is attached to back plate 19, in a horizontal position on the surface of back plate 19 that is facing away from the end of main frame 34. The ends of axle rod 16 protrude equal distance past the ends of the back plate 19. A wheel 10 is inserted on each end of the protruding axle rod 16. An axle cap 20 is affixed to each end of axle rod 16, to secure the wheels 10 to axle rod 16.

A first lower wire caddy assembly 22 is attached perpendicular to main frame 34, on the side of main frame 34, which is perpendicular to back plate 19, near the end opposite back plate 19, with the longer appendage 35 being the bottom and the short appendage 36 containing the wire guide hole 37 being the top. A support bracket 28 is attached to the underside of the longer appendage 35 on the lower first wire caddy assembly 22, and to the lower side of the main frame 34. A second lower wire caddy assembly 22, is attached to the main frame 34, at a distance three quarters of the distance between the first lower wire caddy assembly 22, and the end of the main frame 34, that is attached to the back plate 19, from the first lower wire caddy assembly 22, with the top surface of the lower longer appendage 35 of the second lower wire caddy assembly 22, being in the same plane as the top surface of the lower longer appendage 35 of the first lower wire caddy assembly 22. A first upper wire caddy assembly 25 is attached to main frame 34, centered horizontally between the two lower wire caddy assemblies, with the top surface 26 of upper wire caddy assembly 25, being in the same plane as the top surface 36 of lower wire caddy assembly 22. A second upper wire caddy assembly 25, is attached to the end of main frame 34, opposite the end of main frame 34, that has lower wire caddy assembly 22, attached thereto, with the top surface 26 of the second upper wire caddy assembly 25, being in the same place as the top surface of lower wire caddy assembly 22. All wire caddy assemblies are to be of the same orientation.

Two opposite holes 38 are drilled horizontally through the main frame 34, in the end opposite back plate 19, to accept a detent pin 39 or other similar retaining device to secure the handle or extension cart coupler. One hole 41 is drilled into the top on the main frame 34, near the end of main frame 34, that is opposite back plate 19, a threaded nut 44, is centered over the hole and attached to the main frame 34, thumb screw 43, is inserted into threaded nut 44.

Two tray tube holders 73 are attached on top of and perpendicular to the main frame 34.

Wire Cart Extension

The wire cart extension is similar to the Wire Master Cart. The difference being the Wire Cart Extension has no wheel assembly. Because of the similar nature of the two carts, the details that are the same for the wire cart extension will not be described in detail as these features have already been described.

Coupler 40 on the wire cart extension is inserted into the end of main frame 34, which is opposite the end which contains thumb screw 43, of the wire master cart. Coupler 40, protrudes from the end of main frame 34, coupler 40, has two holes drilled horizontal to main frame 34, to accept a detent pin or other similar device.

Handle 55 has back plate 49, attached to one end. Handle coupler 52, is attached to back plate 49, and perpendicular to handle 55. Handle coupler 52, has two opposite holes drilled through horizontally, with handle 55, oriented in an upright vertical position.

Trays and Support Tube.

Stop pin 70, is inserted through support tube 73, protruding from both sides of support tube 73.

A raised lip in formed ninety degrees to one longer side of rectangle print tray 58, the three remaining sides of print tray 58, are formed at a ninety degree angle in the opposite direction of the raised lip. Two receivers 61 are attached on an angle to print tray 58, oriented in the same direction on the side of print tray 58, as the three formed sides.

Middle tray 67 has all four sides formed at a ninety angle in the same direction. Two tube guides 64 are attached perpendicular to middle tray 67, opposite each other along the long axis and centered on the outside of the short axis.

Top tray 76, has all four sides formed at a ninety degree angle in the same direction. Two receivers 79 are attached to the side opposite the direction of the formed sides, in line with the direction of the long axis, centered on the short axis.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A wire caddy for holding at least one spool of wire comprising:

a support bracket having a bottom section, a top section and a vertical section that extends between the bottom and top sections, the top and bottom sections extending in the same direction from the vertical section;

a wire guide hole being positioned in the top section, the wire guide hole being disposed to receive wire from the spool of wire, a support shaft is secured to the vertical section of the support bracket, the support shaft extends from the vertical section in the same direction as the top and bottom sections, the support shaft is oriented to be substantially parallel to the bottom section, the support shaft is disposed to receive a spool of wire, the spool of wire having end plates with holes through which the support shaft is inserted, the diameter of the support shaft being smaller than the holes on the end plates of the spool of wire, the end plates of the spool of wire being disposed to contacts the bottom section to prevent rotation of the wire spool until wire is advanced from the spool of wire through the wire guide hole, advancement of the wire causes the spool of wire to be lifted from the bottom section to allow the spool of wire to rotate and the wire to be advanced from the spool of wire, upon cessation of the advancing of the wire through the wire guide hole, the spool of wire engages the bottom section to resist rotation of the spool of wire.

2. The caddy of claim 1 wherein more than one wire caddy is positioned on a support to form a cart for several different types of wire.

3. The caddy of claim 2 wherein at least one wheel is secured to one end of the cart to allow the cart to be moveable.

4. The caddy of claim 3 wherein a handle is secured to the end of the cart that is opposite to the end where the at least one wheel is located, the handle assisting in moving the cart.

* * * * *